US009710849B2

(12) United States Patent
Strohfeldt

(10) Patent No.: US 9,710,849 B2
(45) Date of Patent: Jul. 18, 2017

(54) SYSTEM AND METHOD FOR DISPLAYING ITEMS FOR BID

(71) Applicant: Elisa Strohfeldt, Fort Lauderdale, FL (US)

(72) Inventor: Elisa Strohfeldt, Fort Lauderdale, FL (US)

( * ) Notice: Subject to any disclaimer, the term of this patent is extended or adjusted under 35 U.S.C. 154(b) by 600 days.

(21) Appl. No.: 14/447,213

(22) Filed: Jul. 30, 2014

(65) Prior Publication Data

US 2016/0035018 A1 Feb. 4, 2016

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
None
See application file for complete search history.

(56) References Cited

U.S. PATENT DOCUMENTS

| | | | | |
|---|---|---|---|---|
| 3,277,597 | A | 10/1966 | Trame | |
| 3,876,080 | A | 4/1975 | Hultberg et al. | |
| 5,249,668 | A | 10/1993 | Fenton et al. | |
| 5,484,519 | A | 1/1996 | Fenton et al. | |
| 8,392,268 | B2 | 3/2013 | Smith et al. | |
| 2007/0130013 | A1* | 6/2007 | Robert | G06Q 30/0241 705/14.4 |
| 2007/0168258 | A1* | 7/2007 | Asami | G06Q 30/08 705/26.3 |
| 2011/0137706 | A1* | 6/2011 | Howard | G06Q 30/02 705/7.29 |
| 2011/0137742 | A1* | 6/2011 | Parikh | G06Q 20/04 705/26.1 |
| 2012/0085828 | A1* | 4/2012 | Ziegler | G09F 3/14 235/493 |
| 2012/0223131 | A1* | 9/2012 | Lim | G06F 17/30879 235/375 |

(Continued)

FOREIGN PATENT DOCUMENTS

| | | |
|---|---|---|
| CN | 2314420 Y | 4/1999 |
| CN | 2338065 Y | 9/1999 |

(Continued)

OTHER PUBLICATIONS

Aug. 9, 2011—http://www.care2services.com/care2blog/five-ways-nonprofits-can-use-qr-codes.*

*Primary Examiner* — Matthew Zimmerman
(74) *Attorney, Agent, or Firm* — Jacqueline Tadros, Esq.; Jacqueline Tadros, P.A.

(57) ABSTRACT

A system and method for displaying items for bid at a silent auction including, a display device, having at least one display face, for exhibiting a panel having advertising indicia relating to an item offered for bid at the silent auction, and a code on the panel that corresponds to the item offered for bid, such that the code may be entered by a bidder at a remote location relative to the display device for bidding on the item. The system further including a support member for suspending the display device at a first distance from the support member, and at a second distance from a flooring surface of a venue at which the silent auction is being held; and means for removably and rotatably suspending the display device from the support member.

19 Claims, 8 Drawing Sheets

(56) References Cited

U.S. PATENT DOCUMENTS

| | | | | |
|---|---|---|---|---|
| 2013/0026890 | A1 | 1/2013 | Gotzy | |
| 2013/0112760 | A1* | 5/2013 | Schory | G06K 19/06037 235/494 |
| 2013/0325664 | A1* | 12/2013 | Alegre | G06Q 30/08 705/26.61 |
| 2014/0049448 | A1 | 2/2014 | Christensen | |

FOREIGN PATENT DOCUMENTS

| | | | |
|---|---|---|---|
| EP | 2216768 | A1 | 8/2010 |
| WO | 2005060478 | A2 | 12/2005 |
| WO | 2012059327 | A1 | 5/2012 |
| WO | 2013069977 | A1 | 5/2013 |

* cited by examiner

SYSTEM AND METHOD FOR DISPLAYING ITEMS FOR BID

BACKGROUND OF THE INVENTION

1. Field of the Invention

This invention relates generally to a system and method for displaying items for soliciting bids. In particular, the invention relates to a system of display devices that are suspended from a support structure using a system of wires, cables or pulleys for displaying items available for silent auction at events for bidding by attendees.

2. Description of Related Art

Silent auctions are a staple at almost every charity event. Items available for bid at a silent auction are normally displayed along a wall or on a table for viewing by the attendees at the charity event. The attendees are invited to enter a bid and their telephone number on a sheet of paper that is usually attached to a clipboard next to the item on display. At the end of the evening, the attendee with the highest bid is awarded the item for auction. This traditional method of displaying items for bid at a silent auction is the one that has been used since silent auctions were first introduced.

Although the traditional method has enjoyed tremendous longevity, it has numerous drawbacks. For example, one drawback is related to privacy concerns since a bidder's contact information is included on the bidding sheet and may be viewed by anyone attending the event. Another disadvantage is that the items for display are static. Bidders are not encouraged, and are in fact, discouraged from touching the items for bid. This tends to reduce interest in the item and participation in the silent auction suffers as a result. Yet another disadvantage is that a bidder must be at the site of the item for auction in order to enter his or her bid on the sheet attached to the clipboard and must constantly rush back to the site in order to monitor the progress of the auction and see if they have been outbid.

Thus, it is desirable to have a system and method for displaying items for silent auction that addresses privacy concerns of the bidders and also allows bidders to view the items for auction in a manner that invites interaction with the items, and conversation with other attendees, and also allows a bidder to enter a bid, and monitor the progress of the auction at a distance from the item. It is also advantageous to have an improved system that provides for ease of use and mobility and also allows vendors of items for auction, to display their logos and promotional material in the most attractive way in order to generate interest and bids.

SUMMARY OF THE INVENTION

An aspect of the present invention is to provide a method of displaying items available for bid at a silent auction. One embodiment of the present invention includes one or more display panels suspended from a support member by a cord or wire. The display panel or panels provide information regarding an item or items being offered for auction and available for bid. In addition, the display panel may include identifying indicia, such as a name, number, code or the like that is associated with the particular item offered for bid.

An attendee wishing to enter a bid for a particular item may enter the identifying indicia for the item along with a bid and the attendee's contact information, remotely, via an electronic device at a distance from the item.

In one embodiment of the present invention, the display panels may comprise a square, rectangle, circle, triangle or any other suitable geometric shape and size.

In another embodiment of the present invention, display panels may form an enclosed structure or housing, having a chamber within the structure. In a preferred embodiment, one or more lighting units may be housed within the chamber as a means of illuminating the panels thereby providing a more attractive and visually appealing display for the item or items being offered for bid.

In yet another embodiment of the present invention, the display panels may be supported by a rack. In one aspect of the invention, the rack may be rotatable or revolvable.

In one aspect of the present invention, all the panels within a structure or housing relate to a particular item for auction.

An advantage of the present invention is that it provides an attractive means for sponsors to advertise their name or logo by including the same in an alluring manner on one or more panels on the structure. The remaining panels on the structure may provide information about an item for bid.

In a preferred embodiment, a structure or housing comprises the shape of a box having six panels, whereby four faces of the box are display panels. Each of the four display panels may relate to a single item for auction. However in another embodiment, each display panel may relate to a separate item for auction. This latter embodiment is particularly desirable in situations where space is limited.

An object of the invention is to provide an attractive and engaging display including a means of lighting the display, to promote interest and enthusiasm for items available for bid at silent auctions.

An advantage of the present invention is that it allows a bidder to enter a bid discreetly at a relative distance from the item being offered for auction and to monitor the bids remotely, thereby eliminating the need to constantly return to the item to check the progress of the auction.

Another advantage of the present invention is that a bidder's name and contact information are not displayed on a "bid sheet".

Yet another advantage of the present invention is that it allows for the display of numerous items within a limited space.

Another object of the present invention is to provide an interactive display that allows bidders to rotate and turn the panels to view the information and advertising indicia.

Another object of the invention is to provide a portable kit including a series of unassembled displays devices, with an instructional video for assembling the devices, so that the kit may be delivered to a remote location and assembled on site at the remote location.

It is noted that the Summary of the Invention is neither intended nor should it be construed as being representative of the full extent and scope of the present invention. The embodiments described herein may be used in various combinations as described or independently. Moreover, references made herein to "the present invention" or aspects of the invention thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

DETAILED DESCRIPTION OF THE DRAWINGS

Figure 1A:
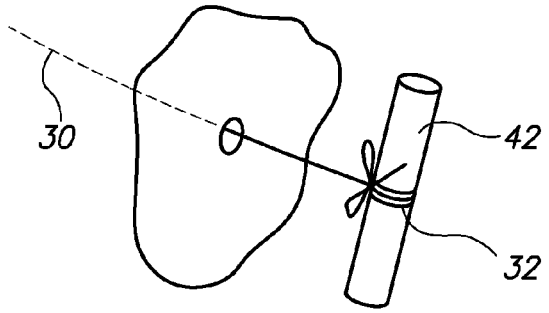
FIG. 1A is a close up view of the first end of the suspension means tied in a loop around a coupling means as shown in FIG. 1.

In the accompanying drawings and following description of the embodiment disclosed therein, like reference characters indicate like parts. Referring now to FIGS. 1-9, the present invention is a system 10 for displaying items 12 for bid at a silent auction. The system 10 includes one or more display devices 14. Each display device 14 further includes at least one display face 16 for exhibiting a panel 17 having advertising indicia 18 on the panel 17 relating to the item 12 offered for bid at the silent auction. In addition to advertising indicia 18 the panel 17 further includes a code 20. The code 20 corresponds to the item 12 offered for bid on the panel 17 on which the item 12 is displayed. In a preferred embodiment, the panel 17 is removably affixed to the display face using an adhesive 19, such as transparent scotch tape.

The code 20, is entered by a bidder 1, bidding on the item 12. In a preferred embodiment, the code 20 is entered by the bidder 1 at a remote location relative to the display device 14 for the purpose of entering a bid on the item 12. The code 20 may also be entered by the bidder 1 for obtaining additional information on the item 12. In an alternative embodiment a quick response code may be scanned by the bidder using a mobile device 23 for entering a bid on the item 12 or for obtaining additional information about the item 12.

The system 10 further includes a support member 24 for suspending the display device 14 at a first distance 26 from the support member 24 and at a second distance 27 from a flooring surface 28 at a venue at which the silent auction is being held.

The system 10 of the present invention further includes suspension means 30 for removably and rotatably suspending the display device 14 from the support member 24. In a preferred embodiment, a wire 31 is used as a means of removably and rotatably suspending the display device 14 from the support member 24. It is appreciated that a chain, cord or thread made of resilient plastic or nylon may also be used as a suspension means 30 removably and rotatably suspending the display device 14 from the support member 24.

In one embodiment, the display device 14 is configured as a square block having a top face 16A, a bottom face 16B, and four display faces 16. In a preferred embodiment the display device 14 is formed of a lightweight transparent vinyl or plastic material. Preferably, the material is malleable enough that it allows the display device 14 to be collapsed into a substantially flat structure when not in use for ease of use and transportation. Preferably the material is also weather resistant and light enough to float in water.

In a preferred embodiment, the top face 16A includes a tuck tab lock enclosure 16C. The tuck tab enclosure 16C includes a slit 36 for receiving a tab 34 positioned along an edge of at least one display face 16. The tuck tab enclosure 16C may be further secured to display faces 16 using an adhesive 19 such as transparent scotch tape.

In an alternative embodiment a top face of the square block includes a plurality of interlocking flaps 16D.

In this embodiment, the interlocking flaps 16D when engaged, provide a modest gap or aperture 52 through which first end 32 of the suspension means 30 may pass. Alternatively, if a tuck tab lock enclosure 16C is used as shown in FIG. 1, a first end 32 of suspension means 30 may be secured to the top face 16A of the display device 14 by first attaching the first end 32 of the suspension means 30 to a coupling means 42, such as a disc or pin and providing an opening 54 in the top face 16A through which the first end of the suspension means 32 may pierce through the top face 16A of the display device 14. In yet another alternative embodiment, once the first end 32 of the suspension means 30 passes through the opening 54, the first end 32 is be tied to form a knot 41 and secured to an underside 15 of the top face 16A using an adhesive 56 such as duct tape.

When the display device 14 is configured as a square block, a first display face 16' is used to exhibit a first panel 17' bearing first advertising indicia 18' and a first code 20' relating to a first item 12' offered for bid. The first panel 17' is removably attached to the first display face 16' of the display device 14. The first panel 17' may also include a first quick response code 22'. A second panel 17" bearing second advertising indicia 18" and a second code 20" relating to a second item for bid 12" is removably attached to a second display face 16". The second panel 17" may also include a second quick response code 22". A third panel 17''' bearing third advertising indicia 18''' and a third code 20''' relating to a third item 12''' for bid is removably attached to a third display face 16'''. The third panel 17''' may also include a third quick response code 22'''. A fourth panel 17'''' bearing fourth advertising indicia 18"" and a fourth code 20"" relating to a fourth item 12"" for bid is removably attached to a forth side face 16'". The fourth panel 17"" may also include a fourth quick response code 22"". The first 16', second 16", third 16'" and fourth 16"" panels may be removably attached respectively to the first 17' second 17" third 17'" and fourth 17"" display faces respectively using transparent scotch tape 19. It can be appreciated by one reasonably skilled in the art that alternative means of removably attaching the panels 16', 16", 16'", 16"" to the display faces 17', 17", 17'", 17"" may be used without departing from the spirit or scope of the invention.

A first end of the suspension means 32 may be coupled to an attachment means 41 such as a disc member or pin for securing the first end of the suspension means 32 to the underside 15 of the top face 16A. Alternatively, the first end of the suspension means 32 may be coupled with another suitable mechanism for securing the suspension means 32 to the underside 15 of the top face 16A. In a preferred embodiment the first end of the suspension means 32 passes through an opening 54 in the top face 16A and a second end of the suspension means 33 is secured to the support member 24.

Thus, the bidder 1 at a silent auction viewing the advertising indicia 18 and wishing to enter a bid on a particular item 12 may enter the bid using the code 20 associated with the particular item 12. The bidder 1 may enter the bid and code 20 remotely, by inputting the code 20 and bid via a mobile computing device 23 such as a smartphone. Alternatively, in a preferred embodiment a quick response code 22 can be scanned using a mobile computing device 23 having a quick response scanner and reader.

An online interactive network site 60 is provided including a network page 62 relating to the particular event having a silent bid auction from which the bidder 1 can enter a bid and the code 20 relating to a particular item 12 for auction.

In a preferred embodiment a plurality of display devices 14 are each suspended from a plurality of support members 24 using a plurality of suspension means 30. In an alternative embodiment, the system 10 of the present invention includes a plurality of interconnected support members 24 from which a plurality of display devices 14 are suspended.

Referring now to FIG. 1, in particular, there is shown an interior view of a preferred embodiment of the display device 14 of the present invention. In this preferred embodiment, the display device 14 is configured as a square, including a housing having an interior chamber 48 within the housing 46. In a preferred embodiment, lighting means 50 are included within the chamber 48. In a preferred embodiment the lighting means 50 are portable battery operated LED lights 50 mounted to an interior surface 47 of the housing 46 for illuminating the display device 14 from within the chamber 48.

In this embodiment, a thin layer of aluminum foil 49 lines the bottom face 16B of the interior of the housing 46. The aluminum foil 49 serves to reflect the light emanating from the LED lights 50, so that the display device is highly illuminated. In addition, a liner 15A, lines the inner side 15 of the top face 16A of the housing 46 of the display device 14. Preferably the liner 15A is a dark color, such as black, in order to accentuate the illumination reflected from the LED lights 50 within the chamber 48.

Figure 1B:
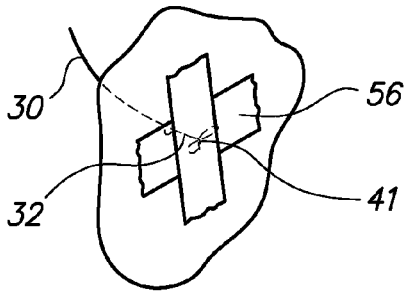
FIG. 1B is a close up view of an alternative means of securing the first end of the suspension means to a block panel device.
Figure 1:
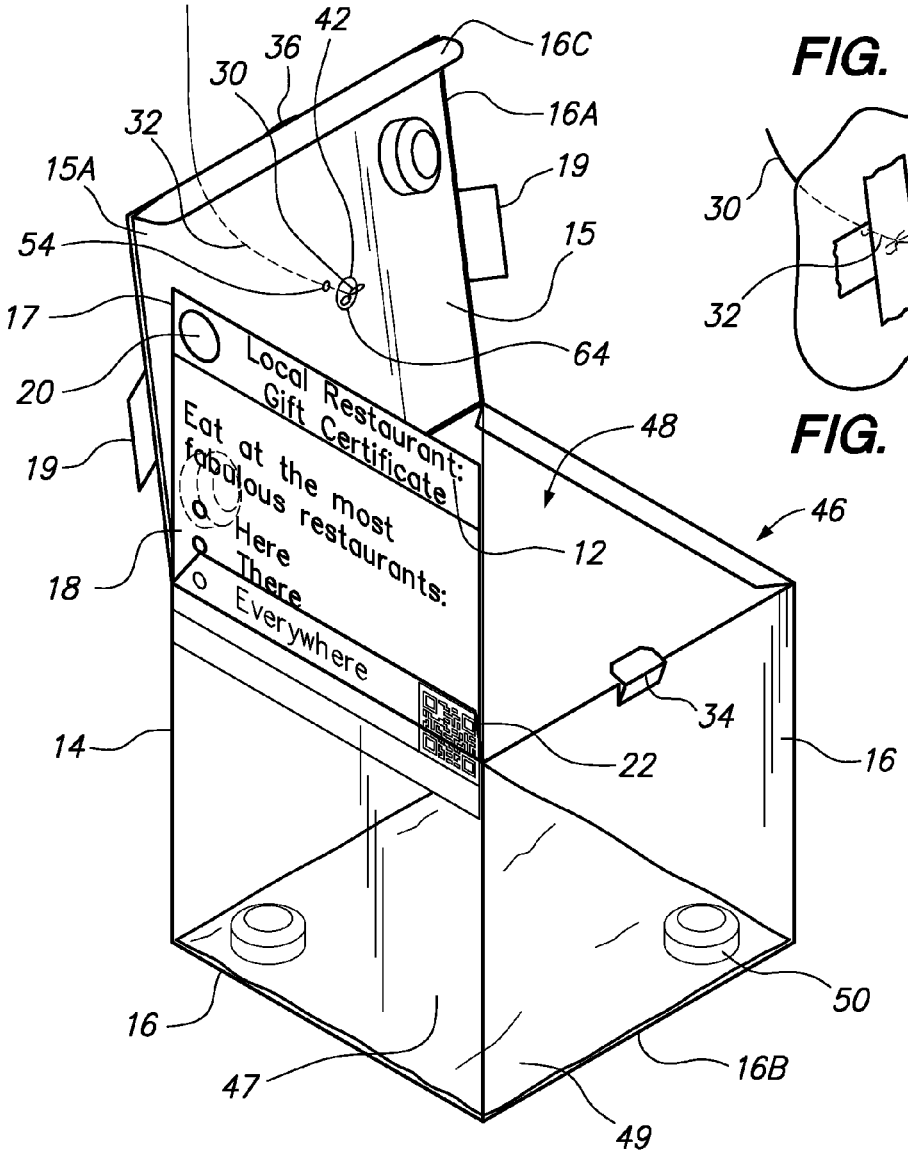
FIG. 1 is a perspective view of a block panel device of the present invention displaying advertising literature on one face.
Figure 2:
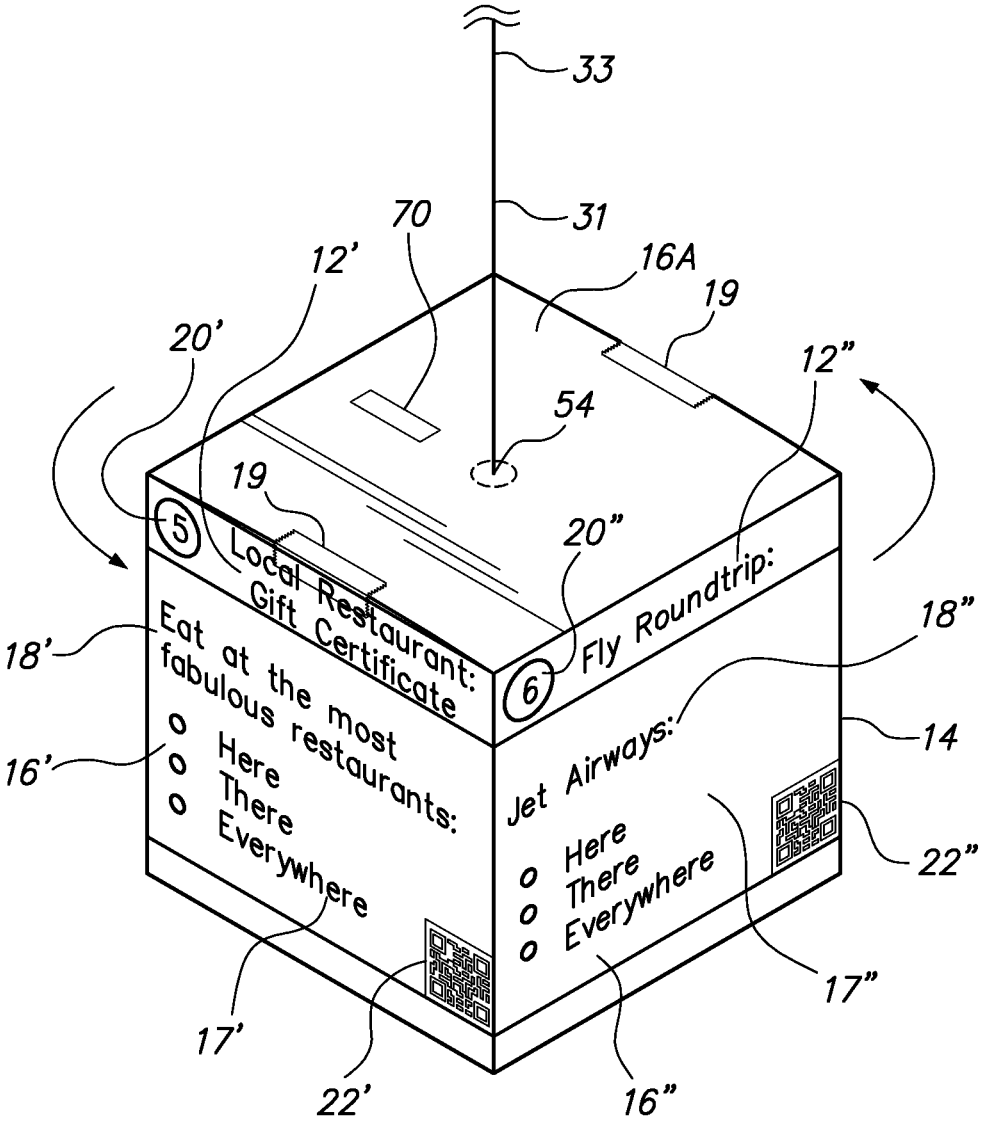
FIG. 2 is a perspective view of a block panel device of the present invention displaying advertising literature on two faces of the block, the block device being suspended and capable of rotation.

FIG. 1 further illustrates a perspective view of the display device 14 of the present invention with advertising indicia or literature 18 relating to the item 12 included on panel 17 for viewing via display face 16. The panel 17 further includes code 20 relating to the item 12 offered for bid. The panel 17 is shown to further include the quick response code 22 for scanning additional information on the item 22 and entering a bid. The quick response code 22 may also be displayed directly on the display device 14 without departing from the spirit and scope of the invention. The quick response code 22 provides additional advertisement and marketing options. The display device 14 in FIG. 1 is configured as a square block. As will be appreciated by one reasonably skilled in the art, the display device 14 may be configured in the shape of a rectangular block, a pyramid, a globe, or any other suitable geometric shape, without departing from the spirit or scope of the present invention. It is noted that the display device 14 may be configured as a two or three dimensional structure. The tab 34 is inserted within slit 36 for receiving a tab 34 when the top face 16A of the display device is in a closed position as shown in FIG. 2. Additionally adhesive tape 19 may be used to further secure the display device 14 in a closed position.

FIG. 1A is a close up view of the first end 32 of the suspension means 30 tied in a loop around a coupling means 42. In FIG. 1A, the coupling means 42 is shown as a cylindrical pin. However as may be readily appreciated, the coupling means 42 may be a flat disc or another coupling means of suitable shape and size, without departing from the spirit or scope of the present invention.

FIG. 1B is a close up view of an alternative means of securing the first end 32 of the suspension means 30 to the top panel face 16A of the display device 14. In this embodiment, once the first end 32 of the suspension means 30 passes through the opening 54 in the top face 16A as shown in FIG. 1, the first end 32 of the suspension means 30 is tied in a knot 41. The first end 32 of the suspension means 30 is thereafter secured to the underside 15 of the top face 15 using adhesive 56 such as duct tape. In a preferred embodiment, a washer 64 (as shown in FIG. 1) may additionally be used to stabilize the first suspension means 30 passing through the opening 54.

FIG. 2 is a perspective view of the display device 14 of the system 10 of the present invention in a closed position displaying advertising indicia or literature 18' and 18" on panels 17' and 17" shown via display faces 16' and 16" of the display device 14 respectively. There is shown the display device 14 being suspended by a nylon thread or wire 31.

In an alternative embodiment, the top face 16A of the display device is provided with a slot 70 for depositing funds, such as cash, checks or other currency in order to provide attendees with an alternative means of donating funds to the auction without necessarily bidding on the items 12.

Figure 3:
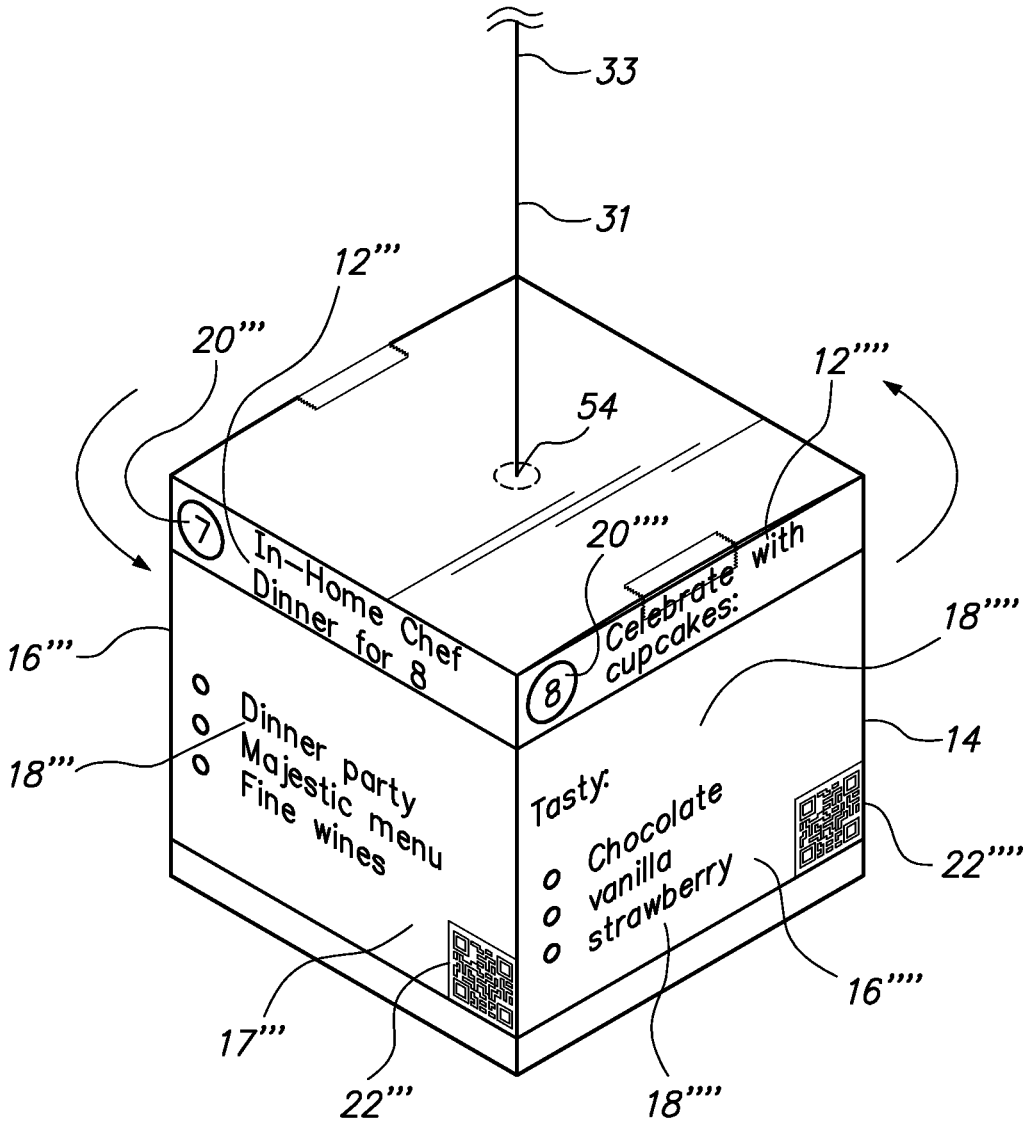
FIG. 3 is a perspective view of a the block panel device of FIG. 2 illustrating the advertising literature on two additional faces of the block panel device of FIG. 2, showing the block device being suspended and capable of rotation.

FIG. 3 is a perspective view of a the block panel device of FIG. 2 illustrating the advertising literature 18'" and 18"" on two additional panels 17'" and 17"" shown via display faces 16'" and 16"" of the block panel device 14, showing the block device being suspended via a suspension wire 31 and capable of rotation.

Figure 4:
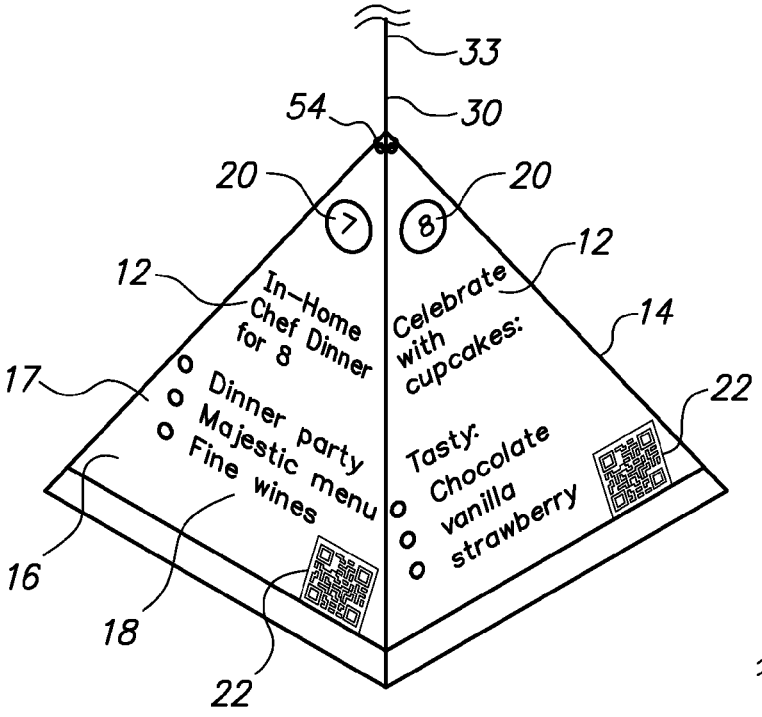
FIG. 4 is a perspective view of an alternative embodiment of a device of the present invention having three faces displaying advertising literature.

FIG. 4 is a perspective view of an alternative embodiment of the display device 14 of the present invention configured as a pyramid with at least two display faces 16 exhibiting at least two panels 17 having advertising literature 18 and codes 20 relating to items 12.

Figure 5:
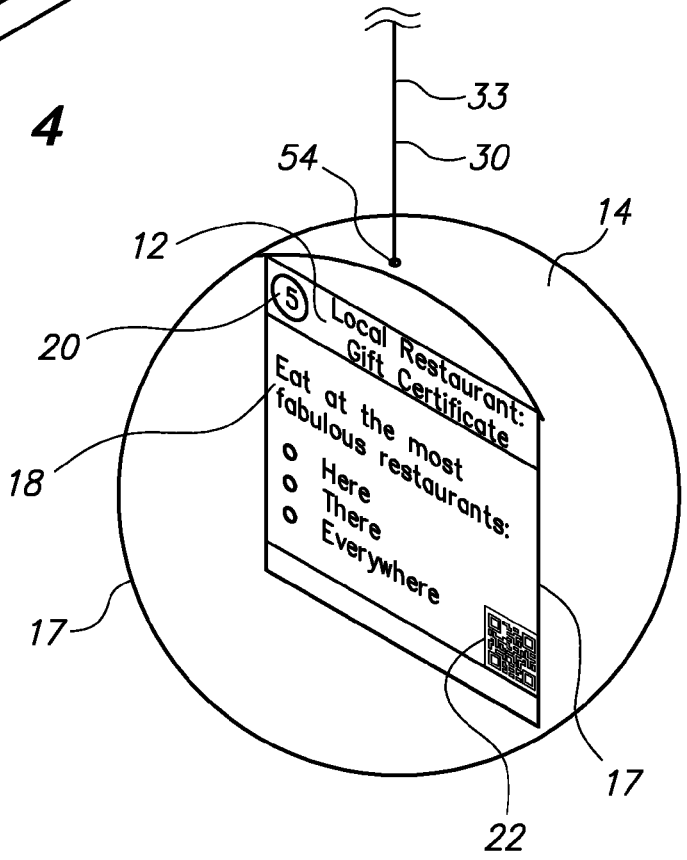
FIG. 5 is perspective view of yet another alternative embodiment of the device of the present invention, wherein the device is in a circular form.

FIG. 5 is perspective view of yet another alternative embodiment of the display device 14, wherein the display device 14 is in a circular form.

Figure 6:
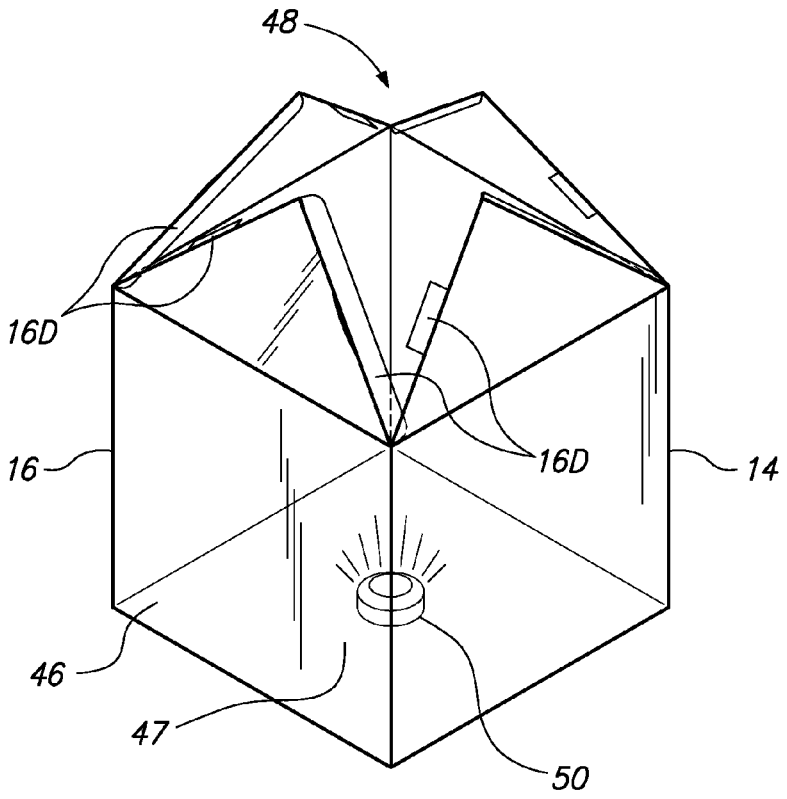
FIG. 6 is a view of a block device of the present invention having an alternative closure and lighting means within the block device for illuminating the block device when displayed.

FIG. 6 is a view of a display device 14 having an alternative closure wherein the top face 16A of the display device is parsed in a plurality of segments having interlocking flaps 16D. The LED light 50 in the interior chamber 48 of the housing 46 illuminates the display device 14 for showcasing the items 12 (shown in FIGS. 1-5; 8) for bid.

Figure 6A:
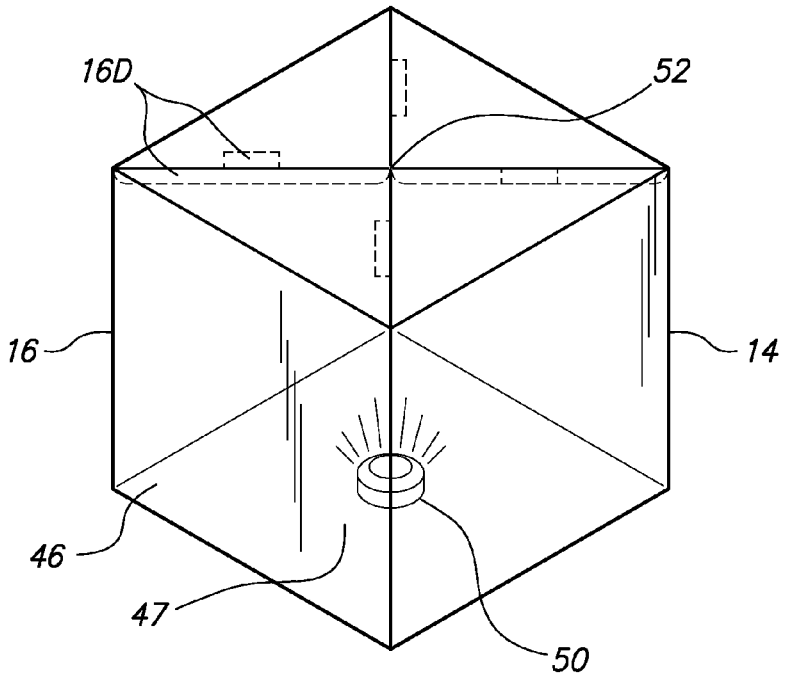
FIG. 6A is a view of the block device of FIG. 6 with the top face panels engaged in an enclosed position

FIG. 6A is a view of the block device of FIG. 6 with the interlocking flaps 16D are engaged to secure the housing 46 in an enclosed position. In this embodiment, the interlocking flaps 16D when engaged, provide the gap 52 through which the first end 32 of the suspension means 30 may pass (shown in FIG. 1).

Figure 7:
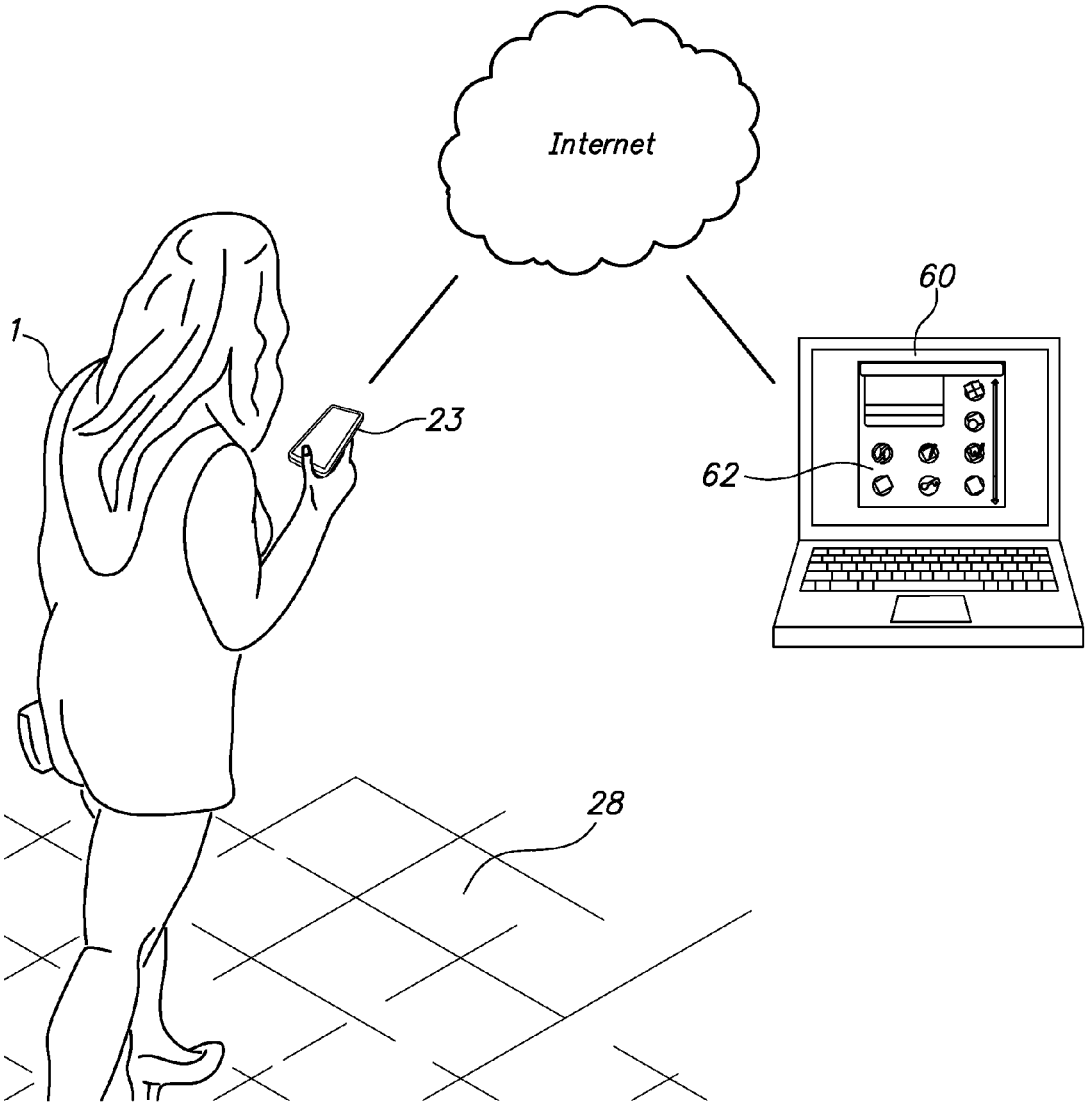
FIG. 7 is an illustration of a bidder using a mobile device to remotely enter a bid with an interactive network site

FIG. 7 is an illustration of the bidder 1 using a mobile device 23 to remotely enter a bid via the online interactive network site 60 including the network page 62 relating to the particular event having a silent bid auction from which the bidder 1 can enter a bid and the code 20 relating to a particular item 12 for auction.

Figure 8:
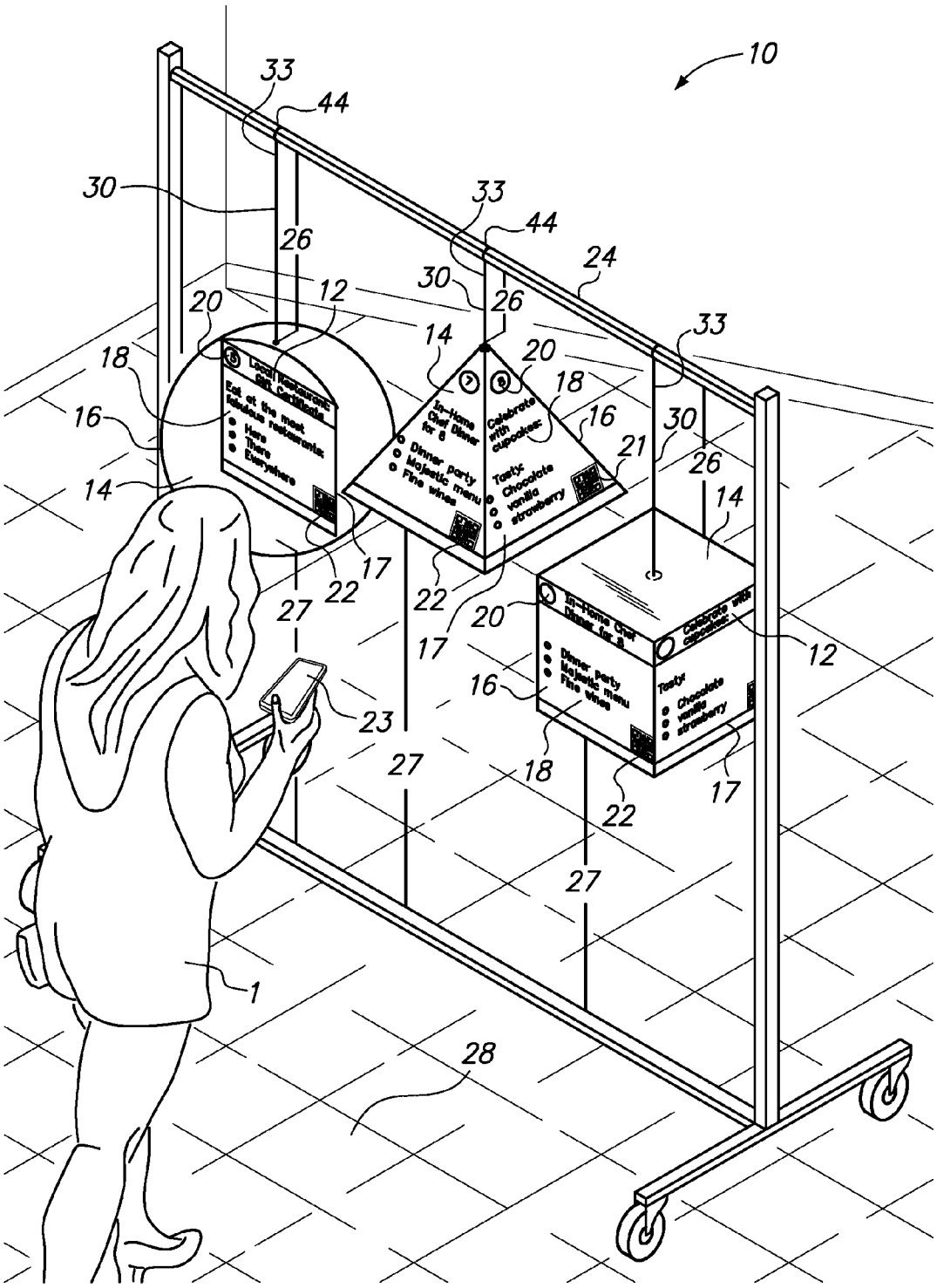
FIG. 8 illustrates a plurality of display devices of the present invention, displaying advertising literature on one or more faces of each of the display devices, the display devices being suspended by a plurality of connecting means from a supporting member for easy viewing.

FIG. 8 illustrates a plurality of display devices 14 having advertising literature 18 on one or more panels 17 of the display faces 16 of each of the display devices 14, the advertising indicia 18 relating to a plurality of items 12, and the display devices 14 being suspended from a supporting member 24 by a plurality of suspension means 30 for easy viewing of the display devices 14 at a full 360° of rotation.

In a preferred embodiment the second end 33 of the suspension means 30 is attached to the support member 24 using a looped knot 44 tied around the support member 24. It is appreciated that the second end 33 of the suspension means 30 may be attached to the support member 24 in alternative ways without departing from the spirit or scope of the invention.

Figure 9:
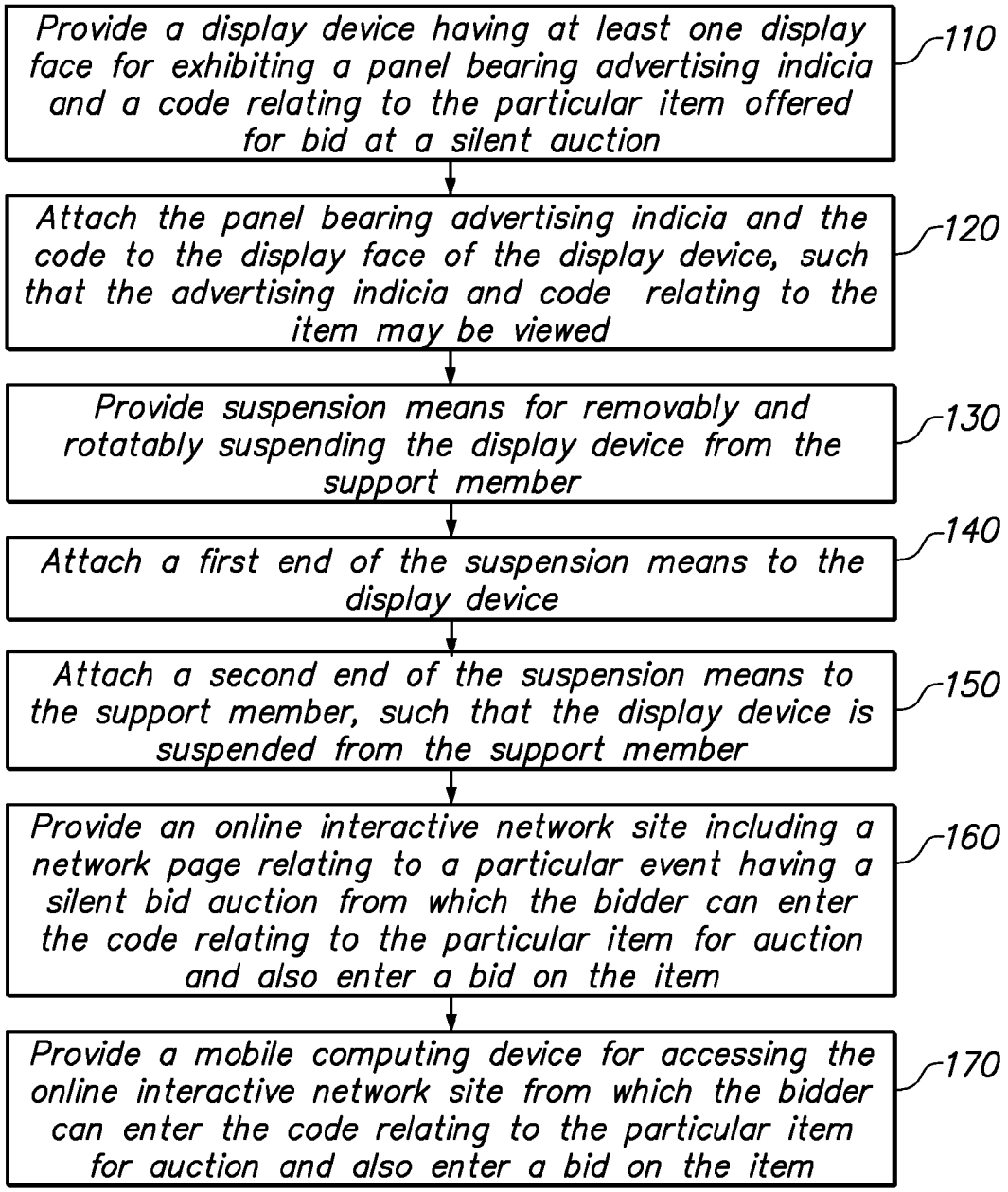
FIG. 9 is a flow chart outlining the method steps of the present invention for displaying items for bid at a silent auction.

FIG. 9 is a flow chart outlining the method steps of the present invention for displaying items 12 for bid and receiving bids at a silent auction. A first step 110 of the method of the present invention is to provide a display device 14 having at least one display face 16 for exhibiting a panel 17 bearing advertising indicia 18 and a code 20 relating to the particular item 12 offered for bid at a silent auction.

A second step 120 is to attach the panel 17 bearing advertising indicia 18 and the code 20 to the display face 16 of the display device 14, such that the advertising indicia 18 and code 20 relating to the item 12 may be viewed by a bidder 1.

A third step 130 is to provide suspension means 30 for removably and rotatably suspending the display device 14 from the support member 24.

A fourth step 140 is to attach a first end 32 of the suspension means 30 to the display device 14.

A fifth step 150 is to attach a second end 33 of the suspension means 30 to the support member 24, such that the display device 14 is suspended from the support member 24.

A sixth step 160 is to provide an online interactive network site 60 including a network page 62 relating to a particular event having a silent auction from which the bidder 1 can enter the code 20 relating to the particular item 12 for auction and also enter a bid on the item 12.

A seventh step 170 is to provide a mobile computing device for accessing the online interactive network site from which the bidder 1 can enter the code 20 relating to the particular item 12 for auction and also enter a bid on the item 12.

In a preferred embodiment, the system of the present invention 10 may be presented in an unassembled format and delivered in a package as a kit complete with instructions for assembly, such that the kit may be delivered to a remote location and assembled on site by the recipient. As a further incentive, the bidder 1 may receive a special discount provided by a sponsor when the bidder 1 purchases an item 12 at auction. Attendees may provide sponsors with their e-mail contact in order to obtain additional information. This is advantageous to sponsors as it will provide the sponsors with access to e-mails that may be used for future marketing.

Thus, while there has been shown and described, fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A system for displaying items for bid at a silent auction comprising:

a collapsible display device, including a housing having an interior chamber, the chamber having at least a first display face and a second display face, wherein the first display face exhibits a first panel having first advertising indicia relating to a first item offered for bid at the silent auction and further includes a first quick response code, wherein the second display face exhibits a second panel having second advertising indicia relating to a second item offered for bid at the silent auction and further includes a second quick response code, and wherein each of the first and second codes may be entered by a bidder at a remote location relative to the display device for bidding on a corresponding item;

a computer server configured to maintain an online interactive network site including a network page relating to a particular event providing the silent auction configured to accept entry of a code relating to a particular item for auction and also configured to accept entry of a bid on the particular item using a mobile computing device;

a support member for suspending the display device at a first distance from the support member, and at a second distance from a flooring surface of a venue at which the silent auction is being held; and a suspension member for removably and rotatably suspending the display device from the support member.

2. The system of claim 1, further including a donation acceptance slot in at least one of the first display face or second display face.

3. The system of claim 1, wherein the means for entering the code is a mobile computing device.

4. The system of claim 1, wherein each of the first quick response code and second quick response code contains information about the item that may be accessed using the mobile computing device having a quick response scanner and reader.

5. The system of claim 1, wherein a plurality of display devices are suspended from the support member.

6. The system of claim 1, wherein a plurality of display devices are suspended from a plurality of support members.

7. The system of claim 6, wherein the plurality of support members are connected to one another.

8. The system of claim 1, further including a sheet of aluminum foil affixed to a display face for reflecting light emitting from a light source positioned within the chamber of the display device.

9. The system of claim 2, wherein the donation acceptance slot having a width and length dimensioned for receiving a deposit of funds, submitted by an attendee wishing to donate proceeds, such that the display device is a receptacle for direct donations.

10. The system of claim 1, wherein the display device is configured as a block structure with a housing, the housing further comprising:

a third display face for exhibiting a third panel bearing a third advertising indicia and a third code relating to a third item offered for bid, the third panel being removably attached to the third display face;

a fourth display face for exhibiting a fourth panel bearing a fourth advertising indicia and a fourth code relating to a fourth item offered for bid, the fourth panel being removably attached to the fourth display face;

a top face;

a bottom face;

an interior chamber enclosed within the housing; and lighting means removably affixed within the chamber, wherein the lighting means are mounted to an inner surface of the housing for illuminating the display device from within.

11. The system of claim 10, wherein the suspension member allows for viewing the display device at 360 degrees of rotation.

12. The system of claim 10, wherein the housing is formed of a malleable lightweight transparent vinyl material for allowing the housing to be collapsed into a substantially flat structure when not in use for ease of use and transportation.

13. The system of claim 10, wherein the top face and the bottom face each include a tuck tab lock enclosure.

14. The system of claim 10, wherein the top face includes a plurality of interlocking panels.

15. The system of claim 11, wherein the support member is a revolving member.

16. A method of offering an item for bid at a silent auction comprising the steps of:

providing a collapsible display device having at least a first display face and a second display face, wherein the first display face exhibits a first panel having first advertising indicia relating to a first item offered for bid at the silent auction and further includes a first quick response code, wherein the second display face exhibits a second panel having second advertising indicia relating to a second item offered for bid at the silent auction and further includes a second quick response code, and wherein each of the first and second quick response codes may be entered by a bidder at a remote location relative to the display device for bidding on a corresponding item;

attaching the first panel to the first display face and second panel to the second display face, such that advertising indicia and codes relating to items may be viewed;

providing suspension for removably and rotatably suspending the display device from a support member;

attaching a first end of the suspension to the display device;

attaching a second end of the suspension means to the support member, such that the display device is suspended a first distance from the support member and suspended a second distance from a flooring surface of a venue at which the silent auction is taking place; and managing an online interactive network site including a network page relating to a particular event providing the silent auction and accepting entry of a code relating to a particular item for auction and entry of a bid on the particular item using a mobile computing device.

17. The method of claim 16, further including the step of: providing a donation acceptance slot in at least one of the first display face or second display face.

18. The method of claim 16, wherein each of the first quick response code and second quick response code may be read with a device having a quick code reader and scanner.

19. The method of claim 16, wherein a notification text is sent to a first bidder to notify the first bidder when a second bidder places a higher bid.

* * * * *